United States Patent [19]

Cruver et al.

[11] Patent Number: 5,033,638

[45] Date of Patent: Jul. 23, 1991

[54] ABOVE GROUND HAZARDOUS LIQUID STORAGE APPARATUS

[75] Inventors: Phil Cruver, McLean; Mark Cruver, Alexandria, both of Va.

[73] Assignee: Ecovault Corporation, Vienna, Va.

[21] Appl. No.: 590,705

[22] Filed: Sep. 28, 1990

[51] Int. Cl.[5] ..... B65D 90/16

[52] U.S. Cl. ..... 220/571

[58] Field of Search ..... 220/571, DIG. 6, 85 S, 220/9.1, 445

[56] References Cited

U.S. PATENT DOCUMENTS

| | | | |
|---|---|---|---|
| 2,531,159 | 11/1950 | Rowell | 220/571 |
| 4,245,748 | 1/1981 | Kuamsdal | 220/571 |
| 4,488,500 | 12/1984 | Mototsuna et al. | 220/571 |
| 4,651,887 | 3/1987 | Patrick | 220/571 |
| 4,826,644 | 5/1989 | Lindquist et al. . | |
| 4,895,272 | 1/1990 | De Benedittis et al. . | |
| 4,960,222 | 10/1990 | Fields, III | 220/571 |

OTHER PUBLICATIONS

Areo-Power Unitized Fueler, Inc.: "Areo-Power: The Storage Solution"; advertisement for Environmentally Safe Aboveground Tank.

Convault; advertisement for "Vaulted Aboveground Fuel Storage Tanks".

Trusco Tank Inc.: "Best Above Ground Fuel Storage Tank; advertisement for Supervault".

Hallmark Tank Vault: "The Economical and Convenient Above Ground Tank"; advertisement for Hallmark Tank Vaults.

*Primary Examiner*—Joseph Man-Fu Moy

[57] ABSTRACT

A vault construction is provided for the storage of hazardous or polluting liquids which comprises an inner cylindrical tank for storing such liquids and an outer casing in which the inner cylindrical tank is housed. The outer casing is of two-piece construction and includes a plurality of ribs extending inwardly from the inner surface thereof in engagement with portions of the outer tank wall and defining a plurality of air spaces between the inner wall of the casing and the outer tank wall. The ribs are discontinuous at the bottom of the casing so as to define a channel along the bottom of the casing. Thus, liquid spilled during filling of the tank or liquid leaking from the tank can collect in the channel. The outer casing further includes an indicator device such as a plug of transparent material located in the bottom of the casing, for providing a visual indication that liquid has collected in the channel.

15 Claims, 3 Drawing Sheets

Fig. 5
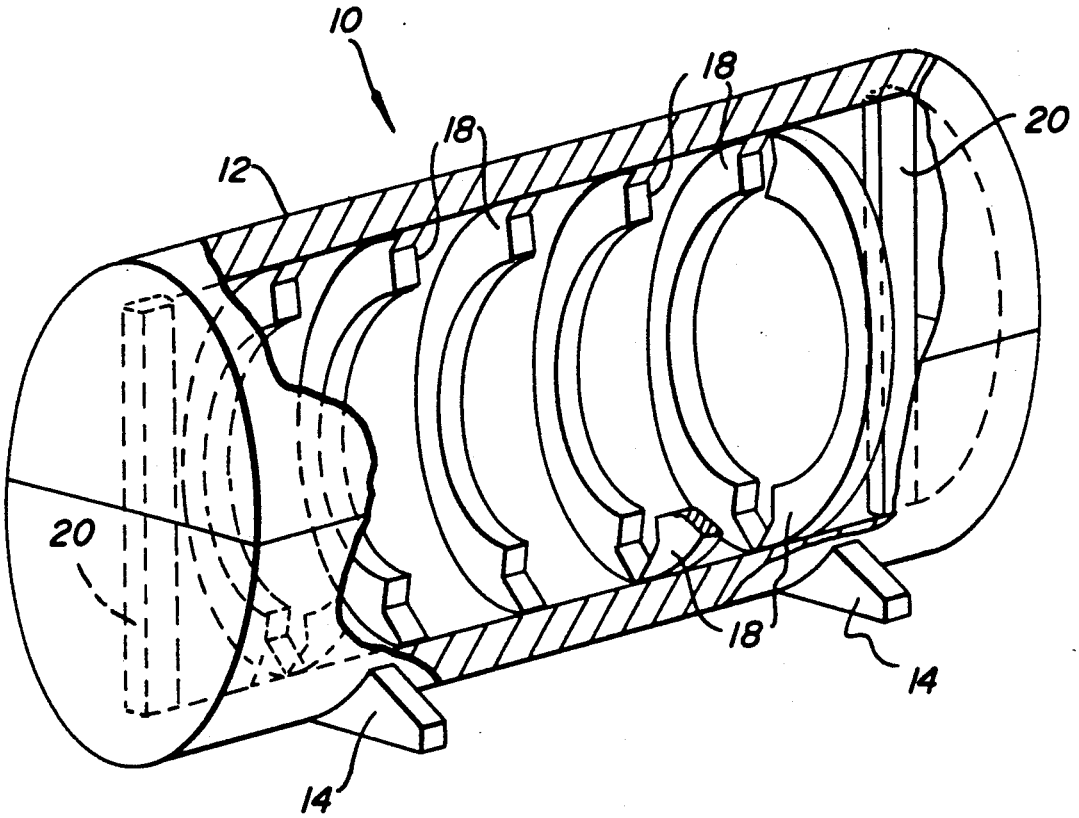
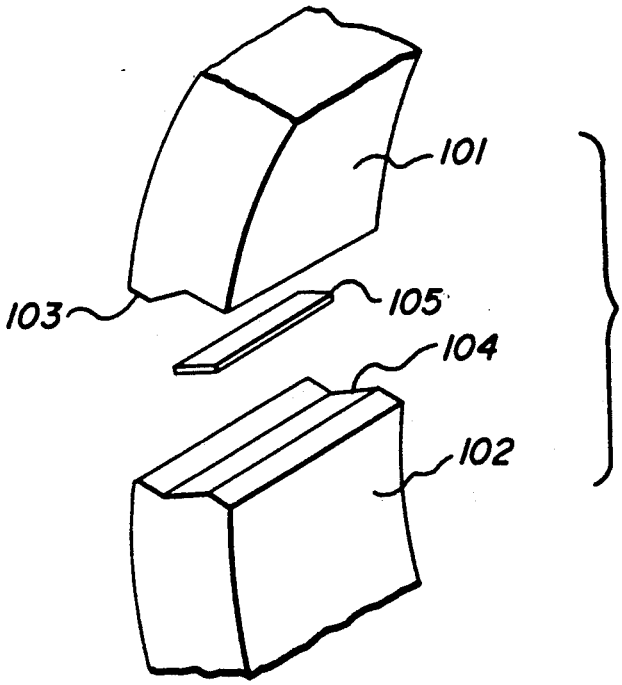
Fig. 6

ABOVE GROUND HAZARDOUS LIQUID STORAGE APPARATUS

FIELD OF THE INVENTION

The present invention relates to the storage of liquids or liquid wastes which are flammable/combustible or otherwise hazardous or pollution-causing, and, more particularly, to an improved above ground liquid storage vault apparatus for this purpose.

BACKGROUND OF THE INVENTION

Increasing interest in protecting the environment has resulted in heightened concerns about the pollution and other dangers resulting from leakage from underground storage tanks for hazardous liquids. Some of these concerns include the problem of leakage of the liquid into ground water supplies and dangers due to fires or explosions. Many of these storage tanks were placed underground in the 1950s and 1960s as a fire prevention measure in order to reduce the risk of damage from stored flammable liquids such as gasoline. Such tanks are often constructed from bare steel, are not protected from corrosion and have now reached or are nearing the end of their useful lives. It has been estimated that as many as 400,000 of these underground storage tanks are now leaking and that many more will begin leaking in the near future.

In an attempt to correct this problem in the United States, the U.S. Environmental Protection Agency (EPA) issued strict regulations at the end of 1988 which mandate certain duties and responsibilities on the part of owners of underground storage tanks including burdensome and expensive corrective action that these owners must take. It will be appreciated that, even apart from the burdens of the EPA regulations, if a leak in a tank is detected, the basic options are limited and burdensome to an owner, i.e., the tank can be drained and abandoned, dug out of the ground and repaired or discarded, or repaired while in the ground, all of which are expensive operations. As the deadline for compliance imposed by the EPA regulations approaches, owners of underground tanks have been considering more and more the alternative of aboveground storage. However, while constructing aboveground storage tanks largely eliminates the need to comply with strict environmental regulations, these regulations are replaced by the vagaries of state and local safety codes. For example, many of the codes require that the inner tank be listed by Underwriter's Laboratory (UL), that secondary containment be provided, and that flammable liquids have a two hour fire wall at 2,000 degrees F. It should be noted that simple aboveground tanks alone are clearly prohibited and that storage "vaults," i.e., tanks within an outer containment, are required. In general, a UL inner tank encased within six inches of concrete will be designated as a vault and will meet most state and local safety codes while being exempted from current Federal regulations.

Some recently developed vault technology involves the use of a custom fabricated rectangular steel tank encased or entombed within a block of standard concrete. An example of such a vault apparatus is that disclosed in U.S. Pat. No. 4,826,644 (Linguist et al) wherein an inner tank is entombed within a concrete outer tank using a specialized method.

A further patent possible interest in U.S. Pat. No. 4,895,272 (DeBenedittis et al.) which relates to a liquid storage system including an external containment vessel which is open on top and an internal storage tank disposed within the external containment vessel so as to define an outer storage space therein. A drainage arrangement provides coupling of liquid from a vent on the internal storage tank to the outer storage space.

SUMMARY OF THE INVENTION

According to the invention, an improved aboveground liquid storage valve construction is provided which overcomes the problems associated with prior art vaults and other storage devices and which also affords a number of advantages, particularly with respect to weight reduction and decreased transportation costs, ease of handling, and increased fire protection. The vault construction of the invention also provides effective secondary containment which is obviously important (and in many instances required by law) in storing flammable and/or otherwise hazardous or pollution causing liquids.

In accordance with a preferred embodiment of the invention, a vault construction is provided for the storage of hazardous or polluting liquids, wherein the vault construction comprises: an inner cylindrical tank for storing such liquids; and an outer cement casing in which said inner cylindrical steel tank is housed and which comprises a plurality of ribs extending inwardly from the inner surface of the casing in engagement with portions of the outer tank wall and defining a plurality of air spaces between the inner wall of the casing and the outer tank wall, the ribs being discontinuous at the bottom of the casing so as to define a channel along the bottom of the casing so that liquid leaking from the tank can collect in that channel, and the outer casing further including an indicator means for providing an indication that liquid has collected in said channel.

In one preferred embodiment, the indicator means comprises a visual indicator means. Advantageously, the visual indicator comprises a plug of transparent material located in the bottom of the casing.

According to an important feature of the invention, the casing is of a two-piece construction. Preferably, the outer casing comprises upper and lower halves which fit together to form the casing, and, advantageously, the upper and lower halves are substantially identical so that manufacturing costs are reduced.

The outer casing is preferably cylindrical in shape and advantageously includes support feet for supporting or stabilizing the casing in a fixed position.

The tank includes a tank fill hole and the outer casing includes a fill hole in alignment with the tank fill hole so as to enable easy filling of the tank. Preferably, the outer casing also includes two or more holes in the wall thereof through which extends a vent connected to the inner tank.

In a preferred embodiment, the outer casing is fabricated of pre-cast reinforced concrete. In an alternative embodiment, the casing is fabricated of pre-cast concrete containing a lightweight filler material such as vermiculite or solite so as to reduce the weight thereof.

Although the casing will normally act as an effective secondary containment, in an alternative embodiment a sealant is coated on the ribs and inner wall to assist is preventing leakage of liquid.

According to a further development of the invention, the vault may include a liquid level gauge which extends through an opening in the upper portion of the casing aligned with an opening in the tank. An upper pump outlet may also be provided, along with an emergency vent. Other aligned openings in the casing and tank may be provided as necessary. An additional feature of a tank according to the invention may include an airspace monitor with an indicator in order to monitor the conditions between the tank and the casing. The casing may be configured as two parts These two parts may either be side-by-side or upper and lower. The respective halves may be fastened together by suitable means. According to an advantageous feature, they may be fastened by bolted clamps. Other fastening mechanisms, such as band clamps.

Rubber gaskets may be provided surrounding the tank and aligned with the ribs. Furthermore, gaskets may be advantageously positioned between the halves.

According to a preferred configuration, the vault may be placed on a concrete spill pad exhibiting raised boundaries and may be protected by one or more barrier posts.

Other features and advantages of the invention will be set forth in, or apparent from, the following detailed description of preferred embodiments of the invention.

Brief Description of the Drawings

FIG. 5 is a perspective view, partially broken away and with parts omitted, of the outer casing of FIGS. 1 to 3, showing the support rib arrangement.

FIG. 6 shows a keying arrangement for a joint between two casing elements.

DESCRIPTION OF THE PREFERRED EMBODIMENTS

Figure 1:
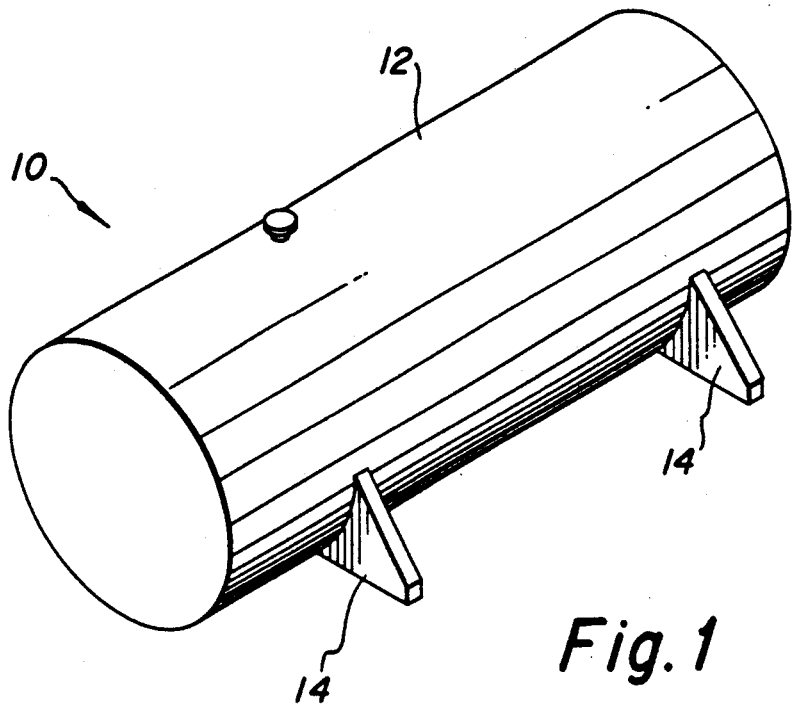
FIG. 1 is a perspective view of a liquid storage vault construction in accordance with a preferred embodiment of the invention.

Referring to FIG. 1, a perspective view of the storage vault of the invention is shown, illustrating the external appearance thereof. The vault, which is generally denoted 10, comprises an outer casing 12 which is generally cylindrical in shape and includes two sets of stabilizing legs or feet 14.

Figure 2:
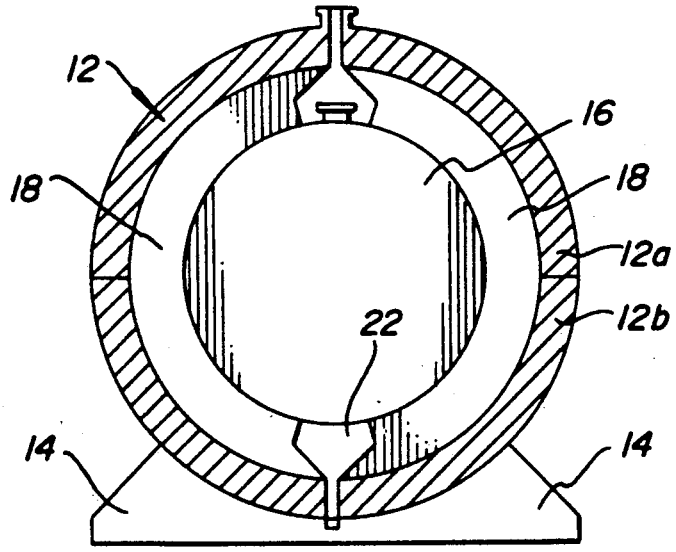
FIG. 2 is a transverse cross section through the vault construction of FIG. 1.
Figure 3:
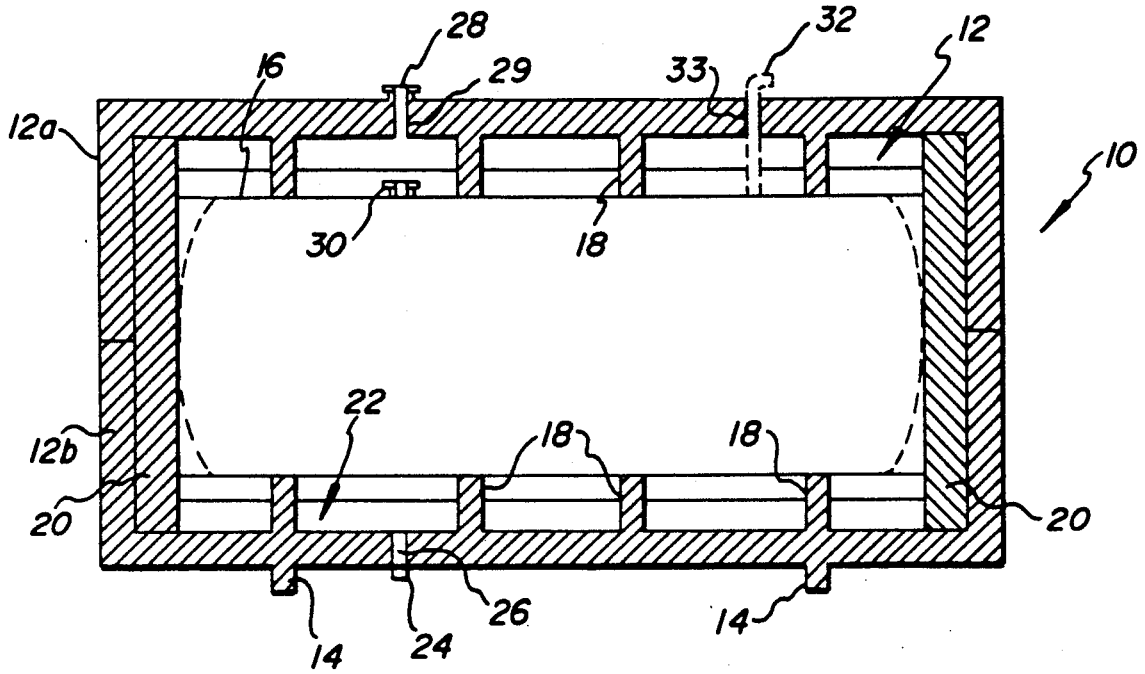
FIG. 3 is a longitudinal cross section through the vault construction of FIG. 1.

Referring to FIGS. 2 and 3, which are, respectively, transverse and longitudinal cross sections of storage vault 10, an inner tank 16 is supported within outer casing 12 by a series of generally semi-annular ribs 18 which extend inwardly from both sides of the inner wall of casing 12. Tank 16 can be of conventional construction and preferably comprises a commercially available steel tank such as that made by other manufacturers. In the illustrated embodiment, the opposed sets of ribs 18 are separated from each other at the top and the bottom as shown in FIG. 2. The shapes of ribs 18 can perhaps best be seen in FIG. 5 which is a perspective view of casing 10 that is partially broken away to shown ribs 18 and in which tank 16 is omitted for purposes of illustration.

The separation of, or discontinuity in, the ribs 18 at the bottom (to which reference was made above) results in a longitudinal channel 22 being defined or formed which permits liquid from a leaky tank 16 to collect in the bottom of outer casing 12. A sight plug 24 of clear hard plastic or the like is located at the bottom of hole or opening 26 in the bottom of outer casing 12 at a point along the lowest level of the inner casing wall so as to provide a visual indication of whether or not liquid, such as from a spill or leak, has collected in channel 22 at the bottom of outer casing 12. It will be understood that plug 24 will appear darker when hole 26 is filled with liquid so that a ready visual indication of a leak or the like is provided. It will be appreciated that other visual indicators and even other types of leak indication (e.g., liquid sensors which activate an audible alarm) can also be employed, although sight plug 24 is generally preferred because of the effectiveness, ruggedness and simplicity thereof.

It will be appreciated that the air space crated by ribs 18 between the outer wall of tank 16 and the inner wall of casing 12 can be designed to enable capture of all of the contents of tank 16 and in a specific exemplary preferred embodiment, the space is 10% greater in volume than the volume of the tank 16 and thus capable of holding 100 more gallons where tank 16 is a thousand gallon tank. Further, this air space provides low-cost thermal protection for the inner tank 16.

Casing 12 further includes a full spout 28, at the top thereof and extending through a hole 29 in the casing wall, which, in cooperation with a tank fill spout 30 enables filling of tank 16. A vent pipe 32 connected to tank 16 extends through a hole 33 in the wall of casing 12 at the top thereof so as to provide venting of tank 16.

Casing 10 is preferably fabricated of concrete and, in an exemplary embodiment, the wall thereof is 6 inches thick. Although in a preferred embodiment, a casing of these dimensions and materials will contain, as a secondary containment, liquid leaking from tank 16, in an alternative embodiment, a non-permeable sealant is applied to the inner wall of casing 12 to prevent leakage through the casing.

Further, although casing 12 is simply made of concrete in accordance with a preferred embodiment, in an alternative embodiment, casing 12 includes a very lightweight filler material such as vermiculite or solite (e.g., by impregnation of the precast concrete), so as to reduce the weight of the casing. It is estimated that the weight of the concrete casing can be reduced in this manner by about one-half while still exceeding fire code standards for the aboveground storage of flammable liquids and thus, can substantially reduce transportation and handling costs depending on the installation methods used.

Figure 4:
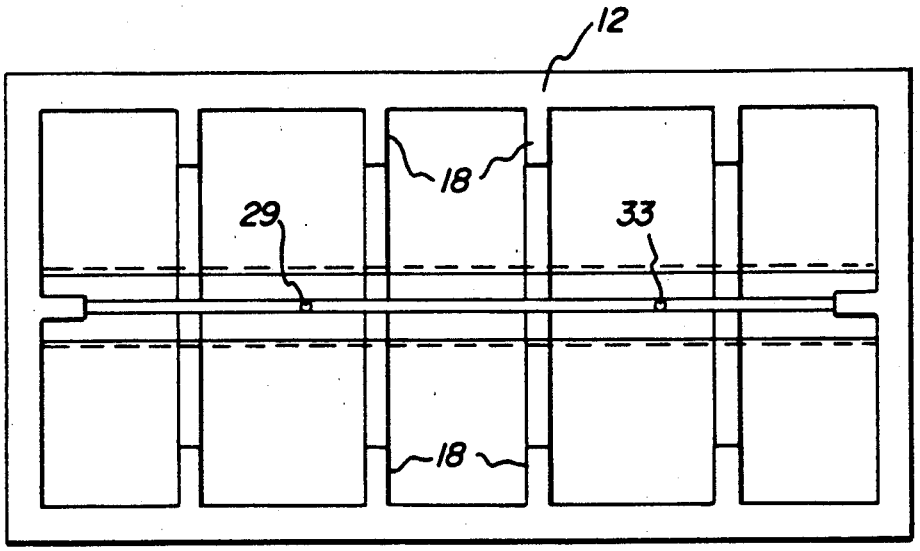
FIG. 4 is an inside plan view of the upper half of the outer casing of FIGS. 1 to 3.

As indicated in FIGS. 2 and 3, outer casing 12 is preferably of a two-piece construction with the two halves being denoted **12*a* and 12*b*. Referring to FIG. 4, an inside plan view of the upper half 12*a* is shown. The mating edges of the two sections can be provided with interlocking shapes such as cooperating tongues and grooves so as to assist in providing a good seal between the two sections. FIG. 6 shows an exploded view of a keying arrangement for the vault casing. The upper casing element 101 is mated to a lower casing element 102. The upper casing element exhibits a keying configuration 103, which will fit a mating configuration 104 displayed on the lower casing element. Advantageously, a gasket 105** may be placed between the upper and lower elements for the purposes of stress relief and sealing.

It will be appreciated that precasting of casing 12 in two sections **12*a* and 12*b*** for final assembly at the site location provides a number of advantages with respect to quality control and ease of shipment and handling.

Although the present invention has been described relative to specific exemplary embodiments thereof, it will be understood by those skilled in the ar that variations and modifications can be effected in these exemplary embodiments without departing from the scope and spirit of the invention.

What is claimed is:

1. A vault construction for the storage of hazardous or polluting liquids, said vault construction comprising:

an inner cylindrical steel tank for storing liquids and including an outer tank wall; and an outer casing in which said inner cylindrical tank is housed and including an inner surface, said outer casing exhibiting a plurality of ribs extending inwardly from the inner surface of the casing defining a plurality of air spaces between the inner wall of the casing and the outer tank wall, said ribs being discontinuous at the bottom of said casing so as to define a channel along the bottom of said casing so that liquid leaking from the tank can collect in said channel, and said outer casing further including indicator means for providing an indication that liquid has collected in said channel.

2. A vault construction as claimed in claim 1 wherein said indicator means comprises a visual indicator.

3. A vault construction as claimed in claim 2 wherein said visual indicator comprises a plug of transparent material located in the bottom of the casing.

4. A vault construction as claimed in claim 1 wherein said outer casing is of a two-piece construction.

5. A vault construction as claimed in claim 1 wherein said outer casing comprises upper and lower halves which fit together to form said casing.

6. A vault construction as claimed in claim 5 wherein said upper and lower halves are substantially identical.

7. A vault construction as claimed in claim 1 wherein said outer casing is cylindrical in shape and includes support feet for stabilizing the casing in position.

8. A vault construction as claimed in claim 1 wherein said tank includes a tank fill hole and said outer casing includes a fill hole in alignment with said tank fill hole for enabling filling of the tank.

9. A vault construction as claimed in claim 1 wherein said outer casing includes a hole in the wall thereof through which extends a vent connected to said inner tank.

10. A vault construction as claimed in claim 1 wherein said casing is fabricated of pre-cast reinforced concrete.

11. A vault construction as claimed in claim 1 wherein said casing is fabricated of pre cast reinforced concrete containing a lightweight filler material.

12. A vault construction as claimed in claim 1 wherein said casing includes a sealant coated on said ribs and the inner surface thereof.

13. A vault construction as claimed in claim 1 wherein said ribs are configured to engage portions of said outer tank wall.

14. A vault construction as claimed in claim 1 wherein said ribs are radially extending circumferential ribs disposed on an inner surface of said casing.

15. A vault construction as claimed in claim 14 wherein a lower portion of said outer casing defines a spill channel.

* * * * *